United States Patent [19]

Tanaka et al.

[11] 4,068,634

[45] Jan. 17, 1978

[54] CONTROL SYSTEM FOR IGNITION TIMING OF ENGINE

[75] Inventors: Minoru Tanaka, Chofu; Youji Ishii, Fujimi; Touru Yagi, Musashino; Syoichi Otaka, Miyoshi, all of Japan

[73] Assignee: Honda Giken Kogyo Kabushiki Kaisha, Tokyo, Japan

[21] Appl. No.: 602,436

[22] Filed: Aug. 6, 1975

[30] Foreign Application Priority Data

Aug. 8, 1974 Japan ..... 49-94012

[51] Int. Cl.[2] ..... F02P 5/04

[52] U.S. Cl. ..... 123/117 A

[58] Field of Search ..... 123/117 A, 146 SA, 115 R

[56] References Cited

U.S. PATENT DOCUMENTS

| | | | |
|---|---|---|---|
| 2,702,028 | 2/1955 | Gintling | 123/117 A |
| 3,301,242 | 1/1967 | Candelise | 123/117 A |
| 3,400,698 | 9/1968 | Kelly | 123/117 A |
| 3,638,626 | 2/1972 | Marshall | 123/117 A |
| 3,727,596 | 4/1973 | Panhard | 123/117 A |
| 3,800,758 | 4/1974 | Sutherland | 123/117 A |
| 3,812,832 | 5/1974 | Scott | 123/117 A X |

*Primary Examiner*—Ronald H. Lazarus
*Assistant Examiner*—Tony M. Argenbright
*Attorney, Agent, or Firm*—Lyon & Lyon

[57] ABSTRACT

Timing control mechanism for an internal combustion engine employs a vacuum chamber connected to a solenoid valve operated by a thermal switch responsive to engine temperature. The solenoid valve connects the vacuum chamber to one of two vacuum outlets connected to the engine intake passage. The first of the outlets is positioned adjacent and upstream from the throttle valve and the second of the outlets is positioned downstream from the throttle valve. The passage from the first outlet to the solenoid valve contains orifice means to restrict flow and also contains a check valve in parallel with the orifice means to permit flow toward the solenoid valve. The passage from the second vacuum outlet contains a check valve preventing flow toward the solenoid valve.

3 Claims, 1 Drawing Figure

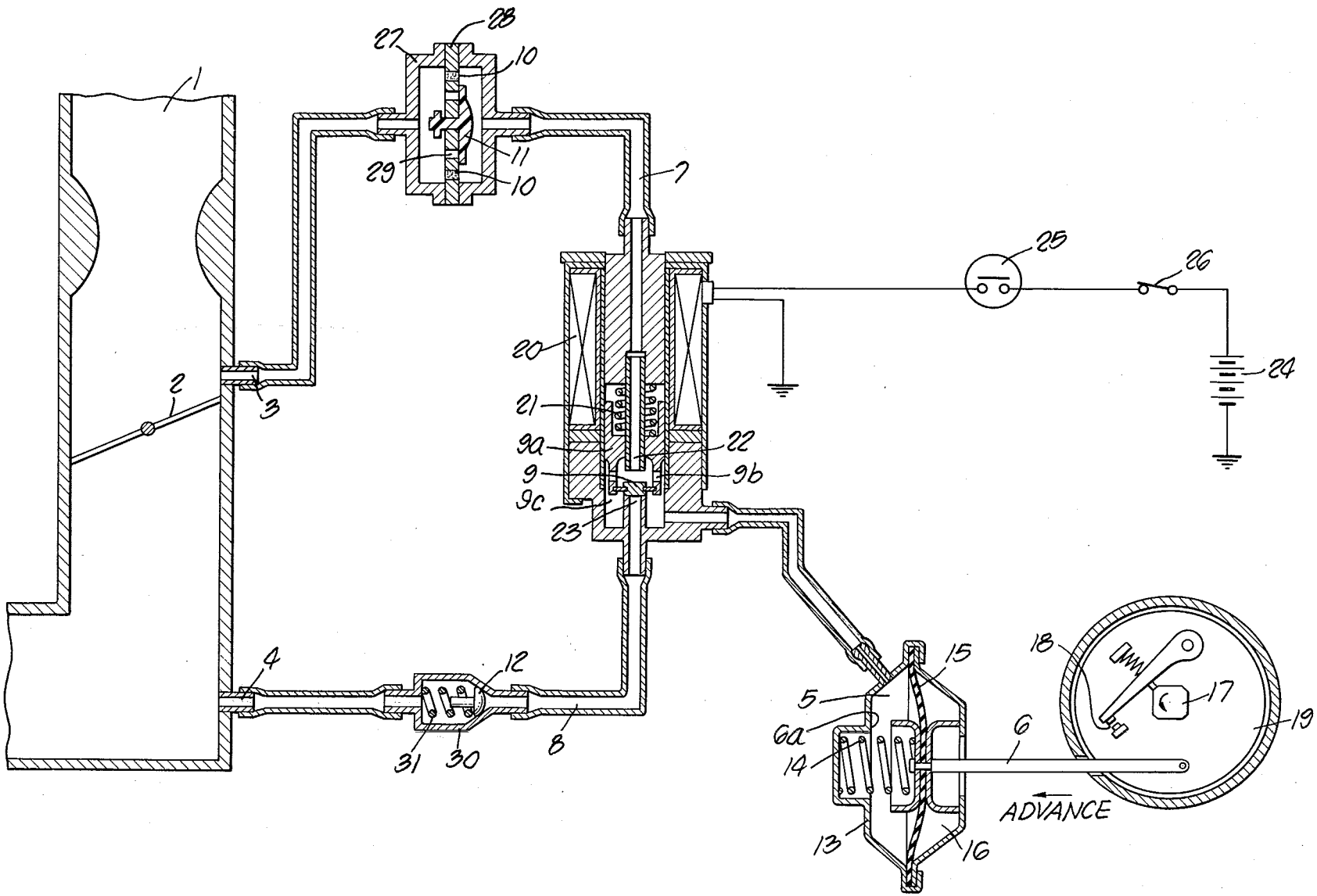
ADVANCE

CONTROL SYSTEM FOR IGNITION TIMING OF ENGINE

This invention relates to ignition timing control systems for internal combustion engines, and it is particularly directed to a vacuum operated system which acts to advance fully the ignition timing when the engine is cold. When the temperature of the engine rises to a predetermined level, the ignition timing is automatically retarded. If the throttle should be opened to cause acceleration of the vehicle, the ignition timing is advanced slowly, but not abruptly. If the vehicle is placed in a state of cruising, the ignition timing is fully advanced. If the throttle valve should be closed to cause deceleration of the vehicle, the ignition timing is immediately retarded. The result of these automatic actions is to minimize unwanted pollutants in the exhaust gases as well as to improve driveability and fuel consumption.

Other and more detailed objects and advantages will appear hereinafter.

The drawing is a schematic view showing a preferred embodiment of this invention.

Referring to the drawings, the intake passage 1 of an engine is provided with the usual throttle valve 2. A first vacuum outlet 3 is located at a position slightly upstream from the throttle valve 2 when the throttle valve 2 is positioned at its idling position, and a second vacuum outlet 4 is positioned at a location downstream from said throttle valve 2. A vacuum chamber 5 is positioned to regulate movement of an ignition timing control member 6.

The vacuum chamber 5 may be connected either to the first passage 7 leading to the first vacuum outlet 3 or to a second passage 8 leading to the second vacuum outlet 4, depending on the position of the selector valve element 9. Orifices 10 are placed in positions to restrict flow through the first passage 7, and a check valve 11 is placed in parallel with the orifices 10. The check valve 11 opens when the vacuum in the vacuum chamber 5 is relatively high. The second passage 8 contains a second check valve 12 which closes when the vacuum at the vacuum chamber 5 is relatively high.

The vacuum chamber 5 is defined between the case 13 and the flexible diaphragm 15. A coil compression spring 14 acts to move the control member 6 in a direction to retard the ignition timing. The chamber 16 within the case 13 on the other side of the flexible diaphragm 15 is open to atmosphere. The control member 6 of rod shaped projects forward from the flexible diaphragm 15 and is pivotally connected to the base plate 19 which carries the separable contact points 18 operated by the rotary cam 17. The base plate 19 is normally turned counterclockwise by forward movement of the control member 6 to retard the ignition timing; rearward movement of the control member 6 turns the base plate 19 in a clockwise direction to advance the ignition timing. Such rearward movement is limited by the stopper surface 6*a*.

The selector valve element 9 is carried by the moving armature 9*a* having ports 9*b*. A spring 21 moves the armature 9*a* in a direction to cause the valve 9 to close the port 23, and the solenoid coil 20 when energized acts to move the armature 9*a* in a direction to compress the spring 21, and cause the valve element 9 to close the port 22. The port 22 communicates with the first passage 7 and the port 23 communicates with the second passage 8. The ports 22 and 23 are carried in aligned pipes which project into the valve chamber 9*c*, and the valve element 9 is located between the ends of these pipes.

A temperature sensor switch 25 closes when the engine temperature is less than a predetermined value, and an ignition switch 26 is placed in series with the switch 25 in a circuit connecting the solenoid coil 20 to a power source 24. Thus, when the engine temperature is relatively low, the switch 25 closes to cause the selector valve element 9 to close against the port 22. The second passage 8 then communicates with the vacuum chamber 5. When the engine temperature rises, the switch 25 opens to shut off the supply of electrical energy to the solenoid coil 20. The spring 21 then moves the armature 9*a* to cause the selector valve element 9 to close against the port 23. The vacuum chamber 5 then communicates with the first passage 7 through the armature port 9*b*.

The orifices 10 and the check valve 11 are provided side by side on a plate 28 mounted within a case 27. The case 27 is positioned about midway in the first passage 7 between the first vacuum outlet 3 and the selector valve element 9. The orifices 10 may each be formed by filling a through hole in the plate 28 with porous sintered metal. The check valve 11 comprises a disk formed of elastomeric material and arranged to cover the holes 29 in the plate 28, and the construction is such that flow is permitted to occur from the first vacuum outlet 3 toward the selector valve element 9, but flow in the opposite direction through the holes 29 is prevented. The orifices 10 permit restricted flow in either direction.

The second check valve 12 is housed in an outer valve case 30 and is held in closed position by means of the spring 31.

While the ignition timing control means shown in the drawings is of the type which turns the base plate 19 for the contacts 18 in a clockwise or counterclockwise direction, this is by way of illustration only, and the ignition timing control means may take other known forms, for example, the form shown in the copending application of Shoichiro Irimajiri et al entitled "Decleration Detector System for Motor Vehicles with Automatic Transmission" and filed July 24, 1975, Ser. No. 598,863, now U.S. Pat. No. 4,020,455 granted Apr. 26, 1977.

In operation, when the ignition switch 26 is closed to start the engine the temperature switch 25 is closed if the engine temperature is relatively low. The selector valve 9 moves to open the port 23 and close the port 22, thus connecting the vacuum chamber 5 through the port 23 to the second vacuum outlet 4 via the second passage 8. Accordingly, a relatively high vacuum at said outlet 4 acts in the vacuum chamber 5 to cause the control member 6 to advance the ignition timing. During such operation, the check valve 12 in the passage 8 acts to keep the vacuum chamber 5 at a relatively stable high vacuum. In case the intensity of the vacuum at the outlet 4 varies to a considerable extent, the check valve 12 opens only when the vacuum is relatively high to allow the vacuum to enter the chamber 5, so that the chamber 5 is normally in the state having a stable relatively high vacuum. The control member 6 is thus stabilized at a position determined by the stopper surface 6*a*. In other words, the ignition timing is fully advanced.

Subsequently, as the engine warms up, the temperature responsive switch 25 opens, causing the selector valve element 9 to move away from the port 22 and close against the port 23, thereby placing the vacuum chamber 5 in communication with the first vacuum outlet 3 by way of the first passage 7 and through the orifices 10 and check valve 11. If the throttle valve 2 should be opened to cause acceleration of the vehicle there is a delay in the increase of intensity of the vacuum in the vacuum chamber 5 because flow is restricted through the orifices 10. This delay prevents sudden advance of the ignition timing, and this in turn reduces unwanted emissions in the exhaust gases at this time.

If the throttle valve 2 remains open and the vehicle is placed in a state of crusing, the vacuum chamber 5, after a delay, reaches a level of vacuum intensity corresponding to that of the vacuum outlet 3, and as a result the flexible diaphragm 15 moves the control member to the limiting position in which the stopper surface *6a* is engaged. The ignition timing is then fully advanced, providing improved fuel consumption.

If the throttle valve 2 should be closed to cause deceleration of the vehicle, the vacuum intensity at the first vacuum outlet 3 reduces, and the elastomeric check valve 11 opens, pulled by the relatively high vacuum in the vacuum chamber 5. The vacuum intensity in the vacuum chamber 5 immediately reduces, and the control member immediately moves the base plate 19 to the retard position, reducing unwanted emissions in the exhaust gases.

From the foregoing description it will be understood that this control system for ignition timing provides automatic control of advance and retard actions, improves driveability during cold running and fuel consumption after warming up, and minimizes production of unwanted emissions in the exhaust gases. It employs a simplified construction having only one control member 6, one vacuum chamber 5 to actuate the control member 6 as common mechanism for control both during cold running and during hot running. Furthermore, the check valve 12 in the second passage 8 keps the vacuum in the vacuum chamber 5 as stable as possible, thereby effectively stabilizing the advance control of the ignition timing.

Having fully described our invention, it is to be understood that our invention is not to be limited to the details herein set forth, but that our invention is of the full scope of the appended claims.

We claim:

1. Ignition timing control apparatus for an internal combustion engine having, in combination: an intake passage and a throttle valve positioned in the intake passage, the intake passage having a first vacuum outlet located above the idle speed position of the throttle valve and subjected to vacuum intensity varying as a function of the degree of opening of the throttle valve from its idle speed position, the intake passage having a second vacuum outlet spaced substantially downstream from the throttle valve, the engine having a distributor including a movable ignition timing control member for varying the ignition timing of the engine and having a vacuum chamber, the vacuum chamber being operatively connected to the ignition timing control member for advancing the ignition timing of the engine in accordance with increase in vacuum intensity in the vacuum chamber, a selector valve assembly communicating with said vacuum chamber, a first passage leading from said first vacuum outlet to said selector valve assembly, a second passage leading from said second vacuum outlet to said selector valve assembly, the selector valve assembly having an element movable from a first position in which said first passage is connected to said vacuum chamber to a second position in which the second passage is connected to said vacuum chamber, means responsive to increasing temperature of the engine for causing said element of the selector valve assembly to move from said second position to said first position, said first passage having a check valve permitting flow toward said selector valve assembly and having orifice means in parallel with said check valve to restrict flow through said passage in the other direction, and a check valve in said second passage permitting flow toward said second vacuum outlet when the vacuum intensity at said second vacuum outlet is greater than at said vacuum chamber and preventing flow toward said second vacuum outlet when the vacuum intensity at said second vacuum outlet is less than at said vacuum chamber, for keeping said vacuum chamber at relatively stable high vacuum intensity.

2. Ignition timing control apparatus for an internal combustion engine having, in combination: an intake passage and a throttle valve positioned in the intake passage, the intake passage having a first vacuum outlet located above the idle speed position of the throttle valve and subjected to vacuum intensity varying as a function of the degree of opening of the throttle valve from its idle speed position, the intake passage having a second vacuum outlet spaced substantially downstream from the throttle valve, the engine having a distributor including a movable ignition timing control member for varying the ignition timing of the engine and having a vacuum chamber, the vacuum chamber having a movable wall connected to the ignition timing control member, a spring acting to move the movable wall in a direction to retard the ignition timing of the engine, the movable wall acting to move the ignition timing control member in a direction to advance the ignition timing of the engine against the spring in accordance with increase in vacuum intensity in the vacuum chamber, an electrically operated selector valve assembly having a valve chamber communicating with said vacuum chamber, a first passage leading from said first vacuum outlet to said valve chamber and having a first pipe projecting into said valve chamber, a second passage leading from said second vacuum outlet to said valve chamber and having a second pipe projecting into said valve chamber, said first and second pipes facing each other in said valve chamber, the selector valve assembly having a valve element positioned between said first and second pipes in said valve chamber, said valve element being movable from a first position in which said first passage is connected to said vacuum chamber to a second position in which the second passage is connected to said vacuum chamber, means including a thermal switch responsive to increasing temperature of the engine for causing said valve element of said electrically operative selector valve assembly to move from said second position to said first position, said first passage having a check valve permitting flow toward said selector valve assembly and having porous means in parallel with said check valve to restrict flow through said first passage in the other direction, and a check valve in said second passage permitting flow toward said second vacuum outlet when the vacuum intensity at said second vacuum outlet is greter than at said vacuum chamber and preventing flow toward said second vacuum outlet when the vacuum intensity at said second vacuum outlet is less than at said vacuum chamber, for keeping said vacuum chamber at relatively stable high vacuum intensity.

3. Ignition timing control apparatus for an internal combustion engine having, in combination: an intake passage and a throttle valve positioned in the intake passage, the intake passage having a first vacuum outlet communicating with a vacuum pressure generating a portion therein and a second vacuum outlet spaced substantially downstream from the throttle valve, the engine having a distributor including a movable ignition timing control member for varying the ignition timing of the engine and having a vacuum chamber, the vacuum chamber being operatively connected to the ignition timing control member for advancing the ignition timing of the engine in accordance with increase in vacuum intensity in the vacuum chamber, a selector valve assembly communicating with said vacuum chamber, a first passage leading from said first vacuum outlet to said selector valve assembly, a second passage leading from said second vacuum outlet to said selector valve assembly, the selector valve assembly having an element movable from a first position in which said first passage is connected to said vacuum chamber to a second position in which the second passage is connected to said vacuum chamber, means responsive to increasing temperature of the engine for causing said element of the selector valve assembly to move from said second position to said first position, and a check valve in said second passage permitting flow toward said second vacuum outlet when the vacuum intensity at said second vacuum outlet is greater than t said vacuum chamber and preventing flow toward said second vacuum outlet when the vacuum intensity at said second vacuum outlet is less than at said vacuum chamber, for keeping said vacuum chamber at relatively stable high vacuum intensity.

* * * * *

UNITED STATES PATENT AND TRADEMARK OFFICE

CERTIFICATE OF CORRECTION

PATENT NO. : 4,068,634

DATED : January 17, 1978

INVENTOR(S) : MINORU TANAKA et al

It is certified that error appears in the above-identified patent and that said Letters Patent are hereby corrected as shown below:

Column 1, line 50, change "shaped" to read --shape--

Column 3, line 37, change "keps" to read --keeps--

Claim 3, line 5, delete "a" at end of line

Claim 3, line 12 (second column), change "t" to read --at--

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*